United States Patent [19]

Frazier

[11] Patent Number: 4,586,106

[45] Date of Patent: Apr. 29, 1986

[54] STATIC DISSIPATIVE TOUCH DEVICE

[76] Inventor: Thomas G. Frazier, c/o J. Penner Corporation, Waterside Industrial Park, Box B113, R.D. #2, New Hope, Pa. 18938

[21] Appl. No.: 735,870

[22] Filed: May 20, 1985

Related U.S. Application Data

[63] Continuation-in-part of Ser. No. 644,321, Aug. 24, 1984.

[51] Int. Cl.[4] ..... H05F 3/00

[52] U.S. Cl. ..... 361/212; 361/220

[58] Field of Search ..... 361/212, 214, 215, 216, 361/219, 220, 222; 174/5 R, 5 G, 6, 35 R; 428/922; D14/114, 115; D18/12; D19/99; 340/365 E, 365 R; 364/189; 200/304, 305

[56] References Cited

U.S. PATENT DOCUMENTS

| | | | |
|---|---|---|---|
| 3,099,774 | 7/1963 | Crane | 361/216 X |
| 3,935,508 | 1/1976 | Moister, Jr. | 361/222 |
| 4,303,960 | 12/1981 | Sherwood et al. | 361/220 X |
| 4,308,568 | 12/1981 | Whewell . | |
| 4,313,148 | 1/1982 | Turner | 361/212 |
| 4,481,556 | 11/1984 | Berke et al. | 361/222 |

FOREIGN PATENT DOCUMENTS

| | | | |
|---|---|---|---|
| 2349809 | 10/1973 | Fed. Rep. of Germany | 361/223 |

*Primary Examiner*—Harry E. Moose, Jr.
*Attorney, Agent, or Firm*—Z. T. Wobensmith, III

[57] ABSTRACT

A static dissipative touch device is provided for discharge of static electricity. The device is attached directly or immediately adjacent to electronic equipment which is susceptible to damage from static electricity. The device is electrically conductive and is readily contacted by the user of the equipment prior to use, to drain off the static electricity and discharge it to ground.

12 Claims, 5 Drawing Figures

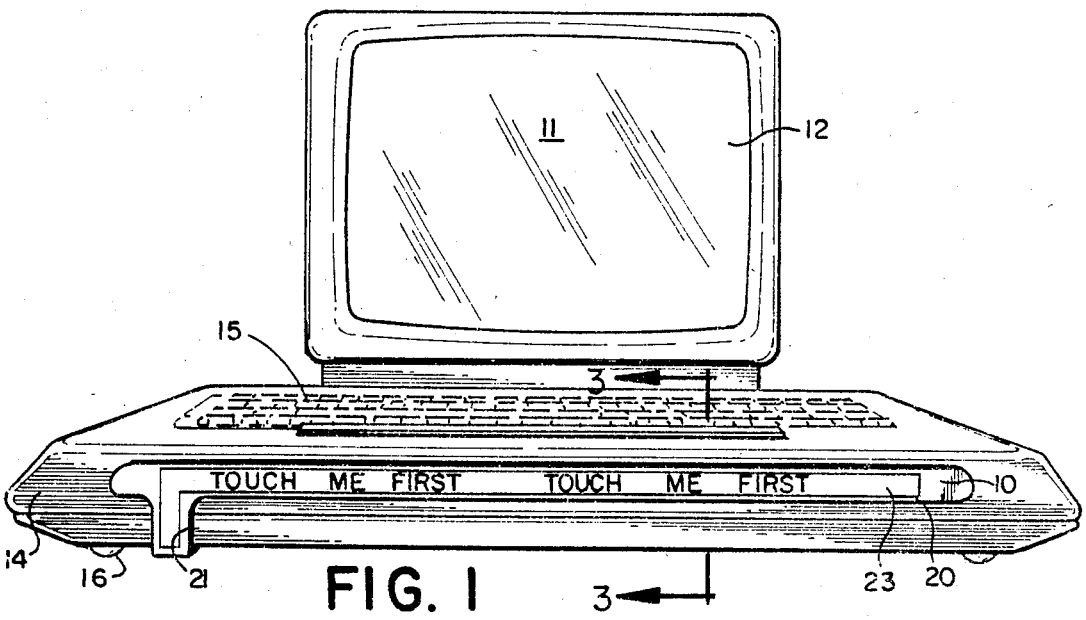
FIG. 1
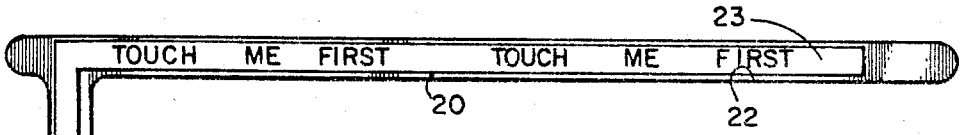
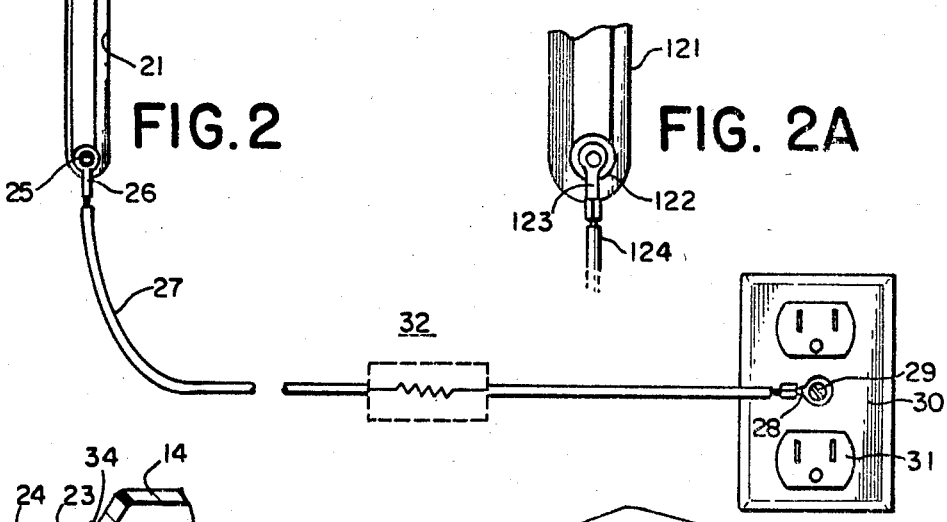
FIG. 2
FIG. 2A
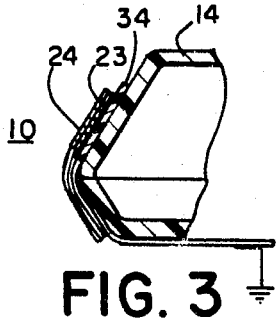
FIG. 3
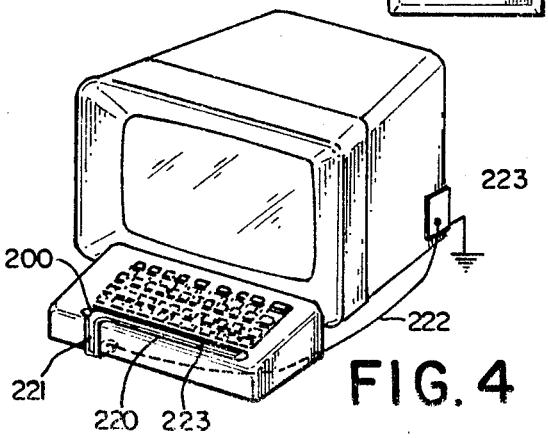
FIG. 4

STATIC DISSIPATIVE TOUCH DEVICE

CROSS REFERENCE TO RELATED APPLICATIONS

This application is a continuation-in-part of my prior application Ser. No. 644,321 filed Aug. 24, 1984 entitled Static Dissipative Touch Bar.

BACKGROUND OF THE INVENTION

1. Field of the Invention

This invention relates to a static dissipative touch device for discharge of static electricity, of the type which is attached to or near equipment and contacted by the user prior to use of the equipment.

DESCRIPTION OF THE PRIOR ART

With the growth and changes in computers and the proliferation of smaller units, much of this type of equipment, and other electronic devices, has been removed from the controlled climatic environment which was originally provided for them, and moved out into normal work environments. Computers and other sensitive low voltage electronic devices are particularly susceptible to damage from static electricity, both by direct electro-static discharge through contact or induction, which was previously controlled in the special computer environments previously provided, but is very difficult to control in a normal work environment.

Electronic equipment, such as office business equipment, can be damaged or disrupted by a charge of as little as 2,000 volts. Static electricity charges of over 10,000 volts can cause permanent damage to various parts of such systems by burning out fragile chips, wiping out or changing programs, and otherwise disrupting the system's operation. Disruption can easily occur through an electro-static discharge several feet away from equipment containing integrated circuits. In fact, it has been established that static electricity charges of up to 30,000 volts can be generated in an office environment by personnel walking across a carpeted floor or rubbing a synthetic garment against itself or an insulated object.

Various solutions have been proposed to control static electricity problems, but none of them have proven completely satisfactory. Static conductive sprays, electrically conductive mats, carpeting and table pads have been used in the past. For example, U.S. Pat. No. 4,308,568 discloses an antistatic construction for use as a floor or wall covering.

U.S. Pat. No. 4,303,960 discloses a means of protecting switch contact elements on a control unit, consisting of providing a conductive surface over the face of the unit to drain static electricity from the user.

The parameters for an optimal device to protect sensitive electronic devices should have all of the following properties:

1. Safely discharge the static charge in less than one second and as close to 0.04 seconds as possible (Note: 0.04 seconds is the approximate time required to drain a static charge of approximately 5,000 volts directed to an electronically conductive ground). This range of drain time is desirable from the standpoint that the operator who ideally passively uses the device does not think how long he or she pauses in touching the anti-static device. Static must drain totally (i.e., to zero potential) and as quickly as possible to be effective in a passive system;

2. Be oriented in a position to allow the device to be touched constantly or frequently to maintain the operator continually free from any electro-static charge build up; and 3. Dissipate the charge without any electric spark or arc, when dissipating a charge in the range of 2,000–30,000 volts (2,000 volts is the approximate potential when visible electrical arcing to ground becomes apparent). A spark of 2,000 or more volts can cause temporary or, in some cases, permanent damage to sensitive integrated circuits contained in the equipment by electronic induction through the air in and around the device.

The anti-static sprays, carpets and mats in use do not prevent static charge build up generated by an operator, if he or she is wearing electrically insulated shoes, such as rubber or crepe soled.

With the current available anti-static mats that are designed to rest on a table or a desk under the equipment, (relying on volume or surface resistivity characteristics of the mat or both surface and volume resistivity) they do not have both the essential characteristics of: (1) static drain time under one second; (2) no possibility of allowing an electro-static discharge spark to occur. This latter requirement is particularly evident in pads with a top layer of static dissipative material, which rely on volume resistivity and an electrically conductive second layer (i.e., 0–100,000 ohms per square) exposed at the edges of the pad. Products on the market which rely on surface resistivity present too conductive a surface (i.e., below 20 megohms per square) at any point on the surface and allow for an electro-static discharge spark to occur at potentials above 5,000 volts at any point on the pad. Current products which rely on volume resistivity without an accompanying second layer are not controlled in a resistivity range to be effective (i.e., drain in less than one second) without displaying electro-static discharge spark at potentials above 5,000 volts.

A satisfactory solution to the static electricity problem requires that there be (1) no electro-static discharge spark or discharge apparent to the equipment or to the user; (2) that the anti-static device used be as passive as is possible to insure that the operator is continually drained of static electricity through the course of the work day; and (3) that the electro-static discharge take place in as short a time as possible, and preferably in the range of 0.04–0.5 seconds.

The apparatus of my invention does not require active participation by the equipment user, but acts in a passive way to to insure its use by the user each time the equipment is accessed by the user. The apparatus of my invention is also easily attachable to a variety of electronic equipment with the use of few or no tools.

SUMMARY OF THE INVENTION

In accordance with the invention, a static dissipative touch device is provided for discharge of static electricity from the user each and every time the device is accessed. The device is easily attached to virtually all types of electronic equipment, and is readily engaged by the user prior to operation of the equipment.

The principal object of the invention is to provide a static dissipative touch device for use in connection with electronic equipment, that is readily contacted by the user prior to use of the equipment to avoid damage to the equipment due to static electricity both through direct discharge or through induction.

A further object of the invention is to provide a device of the character aforesaid which is easily attached directly to the electronic equipment.

A further object of the invention is to provide a device of the character aforesaid which can be installed on and used with a variety of electronic equipment.

A further object of the invention is to provide a device of the character aforesaid which is simple and inexpensive to construct yet sturdy and reliable in operation.

A further object of the invention is to provide a device of the character aforesaid which provides a high degree of safety during use.

Other objects and advantageous features of the invention will be apparent from the following written description and drawings.

DESCRIPTION OF THE DRAWINGS

The nature and characteristic features of the invention will be more readily understood from the following description taken in connection with the accompanying drawings forming a part thereof, in which:

FIG. 1 is a front elevational view of the device of the invention in place on a piece of electronic equipment;

FIG. 2 is a schematic view of the device of the invention as connected for use;

FIG. 2A is a fragmentary view of a portion of the device of FIG. 2 showing another embodiment of the invention;

FIG. 3 is a fragmentary vertical sectional view taken approximately on the line 3—3 of FIG. 1; and FIG. 4 is a view in perspective illustrating another embodiment of the device of the invention installed on a piece of electronic equipment.

It should, of course, be understood that the description and drawings herein are merely illustrative and that various modifications and changes can be made in the structure disclosed without departing from the spirit of the invention.

DESCRIPTION OF THE PREFERRED EMBODIMENT

Referring now to the drawings and to FIGS. 1 to 3 inclusive, one embodiment of the static dissipative touch device of the invention, in the form of a touch bar, is shown at 10. A piece of electronic equipment is shown in FIG. 1, which can be, for example, a personal computer 11, which includes a screen 12, an outer housing 14, and a keyboard 15. The housing 14 is supported by plastic feet 16 which normally rest on a surface (not shown) such as a desk or table, which may itself be antistatic. The equipment 11 is normally grounded.

The touch bar configuration of the device 10 of the preferred embodiment includes an electrically conductive plate portion 20, which is of rectangular configuration with leg 21 perpendicular thereto. The plate 20 and leg 21 are preferably constructed of a soft, pliable sheet material which can be provided with electrical conductivity capabilities and for molding to be described.

In the preferred embodiment, both plate portion 20 and leg portion 21 are constructed integrally and of the same material. The preferred construction consists of a pliant, non-conductive base layer 22 illustrated as a textured substrate coated with an electrically conductive layer 23. The base layer 22 may consist of, for example, a non-conductive plastic or resin such as polycarbonate.

The conductive layer 23 consists of polymer which has been rendered electrically conductive by the addition of, for example, activated carbon black. Various polyesters and vinyl acrylic materials are suitable vehicles for activated carbon black, as is known in the art. It has been found to be particularly desirable to form the electrically conductive layer 23 by depositing, using the silk screen printing process, of an electrically conductive ink upon the textured substrate layer 22. A preferred ink consists of polymethyl methacrylate or vinyl-/acrylic, containing carbon black, in a slow-drying solvent. The methacrylate may be deposited as a monomer, and allowed to cure on the surface of the substrate layer 22. One or more such deposits may be made on the substrate layer 22. An additional non-conductive, protective layer 24 which may be non-conductive ink, is preferably deposited thereon to protect the conductive layer from abrasion or wear.

The conductive characteristics of the conductive layer 23 are controlled by the amount of conductive materials contained in the ink. It is important to control the electrical characteristics of the conductive layer 23, for example, to avoid shock when contact by the user (not shown) is made.

Various experiments have been conducted with strips of varying widths and resistivities as disclosed in the following table:

TABLE I

SURFACE RESISTIVITIES ALONG A STATIC GROUNDING STRIP TO PROVIDE "SAFE" STATIC DISSIPATIVE CONDITIONS

| Distance From Ground Point "O" To Various Positions On The Touch Strip | Length of Strip* Width of Strip *Ground point to end of strip | Surface Resistivity Of Static Dissipative Layer To Give "Safe" Grounding Conditions (in megohms/square) |
|---|---|---|
| 3" (typical minimum acceptable distance from ground) | 15"/.25" | 1.66(min)-15.0 |
| 5" | 15"/.25" | 1.66-15.0 |
| 10" | 15"/.25" | 1.66-15.0 |
| 15" | 15"/.25" | 1.66-15.0(max) |
| 3" | 15"/.375" | 2.5(min)-22.5 |
| 5" | 15"/.375" | 2.5-22.5 |
| 10" | 15"/.375" | 2.5-22.5 |
| 15" | 15"/.375" | 2.5-22.5(max) |
| 3" | 15"/.50" | 3.3(min)-30.0 |
| 5" | 15"/.50" | 3.3-30.0 |
| 10" | 15"/.50" | 3.3-30.0 |
| 15" | 15"/.50 | 3.3-30.0(max) |

Note: It is noted that other width, length, and surface resistivities are possible to give safe conditions, and accordingly, the above examples are simply illustrative.

As illustrated in the examples shown in the table, the device, composed of an electrically insulated substrate, and a semi-conductive layer typically in the range of 1.66-30 megohms per square for a strip that is $\frac{1}{4}$"-$\frac{1}{2}$" in width and a nominal length of 3"-15" away from the ground point. (Resistivity/square, of course, can be altered from this range if the bar is made narrower than $\frac{1}{4}$" or wider than $\frac{1}{2}$" to present surface resistivity on the exposed surface of the strip between 20 and 900 megohms).

The experiments, as illustrated in table 1, demonstrated that surface resistance below 20 megohm at any point on the bar, including its edges or extremities that are readily accessible to the user (the 3" member of the bar is not readily accessible to the user) will result in an electro-static discharge spark when static charges are higher than 2,000–5,000 volts—a non-desirable condition that could lead to electro-static discharge damage by induction. Surface resistivity over 900 megohms will increase drainage time to more than one second—another undesirable condition.

It was found satisfactory to deposit sufficient conductive material to achieve a resistivity in the conductive layer 23 of from 2.5–22 megohms/square.

An additional, and important, feature of the flexible substrate layer 22 which has the electrically conductive ink layer 23 deposited thereon, as described above, is that bending or configuring of the touch bar 10 does not affect or disrupt the conductive surface.

The device can be top coated 24, as shown in FIG. 3, if desired, with a clear varnish coat to improve scuff resistance and improve abrasion resistance on the surface of the bar.

The leg 21, as shown in FIG. 2, has an insulated eyelet 25 and a non-insulated ring terminal 26 which is secured to said leg 21 in electrical contact. Attached to said terminal 26 is a conductive insulated wire 27, which extends to a ring terminal 28. The ring terminal 28 is connected by a screw 29 to the face plate 30 of a grounded electrical outlet 31, or any other suitable ground.

Ideally, an inline resistor 32 is connected to the wire 27 between the ring terminals 26 and 28 which resistor can be of the value of one megohm and which prevents electrical flash back should electricity be present at the ring terminal 28. If a dielectrically insulated eyelet 25 is used to secure the ground cord to the touch device, no in-line current limiting resistor 32 is required. The insulated eyelet will prevent the user from directly touching any portion of the conductive ground cord, and accordingly, the user will be able to contact the touch bar only at points having a surface resistivity to ground greater than one megohm.

Referring now to FIG. 2A, another embodiment of the device is illustrated with a leg 121 which has a resistor washer 122 of well known type attached thereto, and to which a ring terminal 123 is attached, with an insulated wire 124 connected to a suitable ground (not shown) as described for FIG. 2.

Referring to FIG. 3, the plate portion 20 is preferably provided with a backing of double-faced self-adhesive cushioned tape 34, of a well known type, which retains the device to the housing surface 14 of the equipment in any desired location.

Referring now more particularly to FIG. 4, another embodiment of device 200 of the invention is illustrated, in place on a piece of electronic equipment 11, as described in connection with FIG. 1. The device 200 includes a plate portion 220, a leg 221, and has a piece of conductive, insulated wire 222 fastened to the leg 221 as described previously for leg 21. An electrically conductive layer 223 is provided as described for layer 23.

The wire 222 should ideally contain an inline one megohm resistor, and is connected directly to a grounding plate 223 of the equipment 11, which is separately grounded.

One of the benefits of this embodiment is that the length of the ground cord required to accomplish the grounding task is substantially reduced.

The mode of operation and use will now be pointed out.

The adhesive tape 34 of the device such as for 10, is pressed against the housing 14 of the electronic equipment at the desired location, and the plate portion 20 and leg 21 can be bent and molded to fit the contours of the housing, and also to place the leg 21 out of the way of the machine user.

The ring terminal 28 can be connected to a properly grounded outlet 31 by screw 29, or if the touch bar 200 is used as shown in FIG. 4, it can be applied as described for bar 10, with the difference being that wire 222 is connected to the grounding plate 223 on the equipment.

The device of the present invention is easy to install and use. The user, when operating the equipment 11, merely has to touch the bar 10, 100 or 200 prior to using the keyboard 15, and any static electricity is automatically discharged without arcing, in well under one second, and is then carried away by the conductive layer of the device to ground, thereby protecting the equipment from static electric shock.

It will thus be seen that a device has been provided with which the objects of the invention are achieved.

I claim:

1. A static dissipative touch device for use in combination with electronic equipment for protecting said equipment from electrical damage of the type comprising a non-conductive base layer;

an electrically conductive layer applied to said base layer;

grounding means connecting said conductive layer to ground; and means for applying said device to the housing of said equipment the improvement comprising forming said base layer of a pliant, polymeric material and forming said conductive layer as a static dissipative layer by depositing an electrically conductive polymer material on said base layer as said static dissipative layer.

2. A static dissipative touch device for use in combination with electronic equipment for protecting said equipment from electrical damage, comprising a non-conductive base layer and an electrically static dissipative layer applied to said base layer, wherein the base layer and static dissipative layer are in the form of an elongated, rectangular touch bar, and wherein a leg portion extends from said bar and forms a continuation thereof, the bar and leg providing an offset "T" shaped configuration;

grounding means connecting said static dissipative layer to ground, said grounding means being connected to said leg portion; and means for applying said device to the housing of said equipment.

3. A touch device as defined in claim 2 in which said bar and said leg have a protective coating thereon.

4. A touch device as defined in claim 2 in which said base layer consists of a pliant, polymeric material.

5. The touch device as defined in claim 4, wherein said conductive layer is formed by depositing electrically conductive ink on said base layer.

6. The touch device as defined in claim 5, wherein said conductive ink consists essentially of vinyl acrylic polymer and carbon black.

7. The touch device as defined in claim 5, wherein said conductive layer consists of polymethyl methacrylate and carbon black.

8. The touch device as defined in claim 5 having an additional layer of non-conductive ink applied to said conductive layer as a protective layer.

9. The touch device as set forth in claims 5, 6, or 7 wherein said conductive layer of said device has a resistance of from 1.66 to 30 megohms/square for a $\frac{1}{4}''$–$\frac{1}{2}''$ width bar with a length 3"–15" from ground, to provide a surface resistance at any point on the bar between 20 and 900 megohms.

10. A touch device as defined in claim 1 in which said grounding means includes an insulated eyelet with a non-insulated ring terminal in electrical contact with said conductive layer, and an insulated wire connecting said ring terminal to ground.

11. A touch device as defined in claim 10 in which a resistor is provided connected to said wire between said non-insulated ring terminal and said ground to prevent electrical flash back.

12. A touch device as defined in claim 1 in which said means for applying consists of an adhesive layer on said base layer.

* * * * *